US006397828B2

(12) United States Patent
Poggio et al.

(10) Patent No.: US 6,397,828 B2
(45) Date of Patent: Jun. 4, 2002

(54) METHOD FOR CONTROLLING THE TITRE OF THE AIR-FUEL MIXTURE IN AN INTERNAL COMBUSTION ENGINE

(75) Inventors: Luca Poggio, Spinetta Marengo; Andrea Gelmetti, Bologna; Daniele Ceccarini, Rimini; Eugenio Pisoni, Turin; Marco Peretti, Volvera, all of (IT)

(73) Assignee: Magneti Marelli S.p.A. (IT)

( * ) Notice: Subject to any disclaimer, the term of this patent is extended or adjusted under 35 U.S.C. 154(b) by 0 days.

(21) Appl. No.: 09/774,023

(22) Filed: Jan. 31, 2001

(30) Foreign Application Priority Data

Feb. 1, 2000 (IT) ..... BO00A0040

(51) Int. Cl.[7] ..... F02D 41/14
(52) U.S. Cl. ..... 123/673
(58) Field of Search ..... 123/673

(56) References Cited

U.S. PATENT DOCUMENTS 5,462,037 A * 10/1995 Hasegawa et al. ..... 123/673
5,548,514 A * 8/1996 Hasegawa et al. ..... 123/673
5,566,071 A * 10/1996 Akazaki et al. ..... 123/673
5,623,913 A * 4/1997 Kitajima et al. ..... 123/673
5,983,874 A 11/1999 Suzuki et al.

FOREIGN PATENT DOCUMENTS

| | | |
|---|---|---|
| EP | 0330934 | 9/1989 |
| EP | 0408206 | 1/1991 |
| WO | 9936690 | 7/1999 |

* cited by examiner

*Primary Examiner*—Erick Solis
(74) *Attorney, Agent, or Firm*—Hall, Priddy, Myers & Vande Sande

(57) ABSTRACT

A method for controlling the titre of the air-fuel mixture in an internal combustion engine provided with at least two cylinders, in which the exhaust gas present in a common exhaust manifold is analyzed in order to measure at least two successive values of the overall air-fuel ratio of the cylinders; a value of the air-fuel ratio of a final combusted cylinder being estimated by carrying out a linear composition of the two successive values of the overall air-fuel ratio of the cylinders and the value of the air-fuel ratio of the final combusted cylinder being attributed to a first of the cylinders and being used to correct a titer of the air-fuel mixture introduced into the first cylinder.

14 Claims, 2 Drawing Sheets

METHOD FOR CONTROLLING THE TITRE OF THE AIR-FUEL MIXTURE IN AN INTERNAL COMBUSTION ENGINE

The present invention relates to a method for controlling the titre of the air-fuel mixture in an internal combustion engine, in particular an internal combustion engine for driving vehicles.

BACKGROUND OF THE INVENTION

The regulations relating to road vehicles are requiring an increasingly thorough reduction of the pollutant emissions emitted by internal combustion engines. These pollutant emissions can be reduced substantially in two ways: by optimising the combustion process in the cylinders of the engine or by treating the exhaust gases before they are emitted into the atmosphere (typically using exhausts of a catalytic type). In order to optimise the combustion process in the cylinders it is necessary to maintain the titre of the air-fuel mixture as close as possible to the stoichiometric value in each cylinder.

The internal combustion engines that are currently in use are provided with a plurality of cylinders (generally four), each of which has a respective exhaust duct communicating with a common exhaust manifold disposed upstream of an exhaust provided with a device for reducing pollutant agents. In order to contain costs, only the overall stoichiometric ratio of all the cylinders is measured by means of a linear oxygen sensor disposed in the common exhaust manifold.

By means of appropriate reconstruction methods and starting from the measurements of the overall stoichiometric ratio, the stoichiometric ratios of the individual cylinders are estimated and these stoichiometric ratios are used to control the intake of fuel into the individual cylinders, in order to cause each individual cylinder to work as close as possible to the stoichiometric value.

These known reconstruction methods for estimating the stoichiometric ratios of the individual cylinders from the measurements of the overall stoichiometric ratio are, however, relatively imprecise and very complex.

SUMMARY OF THE INVENTION

The object of the present invention is to provide a method for controlling the titre of the air-fuel mixture in an internal combustion engine, which is free from the above-described drawbacks and which is, moreover, simple and economic to implement.

In accordance with the present invention, a method for controlling the titre of the air-fuel mixture in an internal combustion engine according to claim 1 is provided.

BRIEF DESCRIPTION OF THE DRAWINGS

The present invention will now be described with reference to the accompanying drawings, which show a non-limiting embodiment thereof, in which.

DETAILED DESCRIPTION OF THE INVENTION

Figure 1:
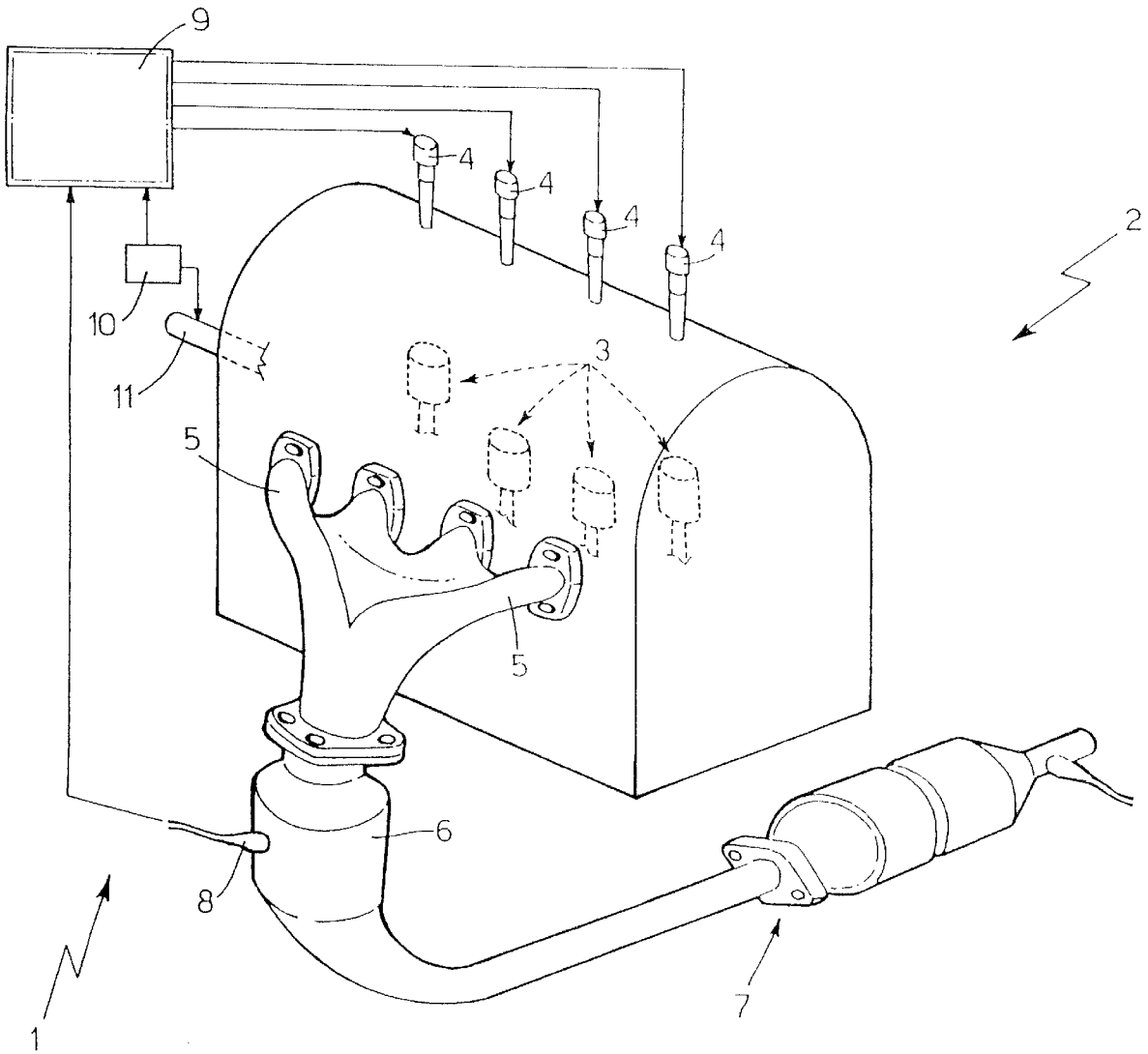
FIG. 1 is a diagrammatic view of an internal combustion engine using the control method of the present invention.

In FIG. 1, a device for controlling the titre of the air-fuel mixture in an internal combustion engine 2 provided with four cylinders 3 (shown diagrammatically) disposed in line is shown overall by 1. Each cylinder 3 receives the fuel from a respective injector 4 of known type and is provided with a respective exhaust duct 5 which communicates with an exhaust manifold 6 common to all the cylinders 3.

The exhaust manifold 6 communicates with an exhaust device 7 of known type and comprises a linear oxygen probe 8 (commonly known to persons skilled in the art by the name "UEGO probe"), which is adapted to measure the percentage of oxygen present in the manifold 6; as is known, the percentage of oxygen in the exhaust gases of the cylinders 3 is in a bi-univocal relationship with the overall air-fuel ratio of the cylinders 3 and a measurement of this oxygen percentage therefore corresponds substantially to a measurement of the overall air-fuel ratio of the cylinders 3.

The control device 1 comprises a control unit 9, which is connected to the probe 8 in order to receive the measurements of the overall air-fuel ratio of the cylinders 3, and is connected to the injectors 4 in order to provide each injector 4 with a correction value of the quantity of fuel injected into the respective cylinder 3. Each injector 4 is in particular controlled in a known manner by an injection control unit (not shown) in order to inject a predetermined quantity of fuel into the respective cylinder 3 (or into an intake duct of this cylinder 3); each injector 4 also receives a signal for the correction of the quantity of fuel to be injected from the control unit 9 in order to try to cause the respective cylinder 3 to work as close as possible to the stoichiometric value.

The control device 1 further comprises a sensor 10 of known type (typically an angular encoder) which is connected to the control unit 9 and is adapted to read the angular position of a drive shaft 11 (shown diagrammatically).

Figure 2:
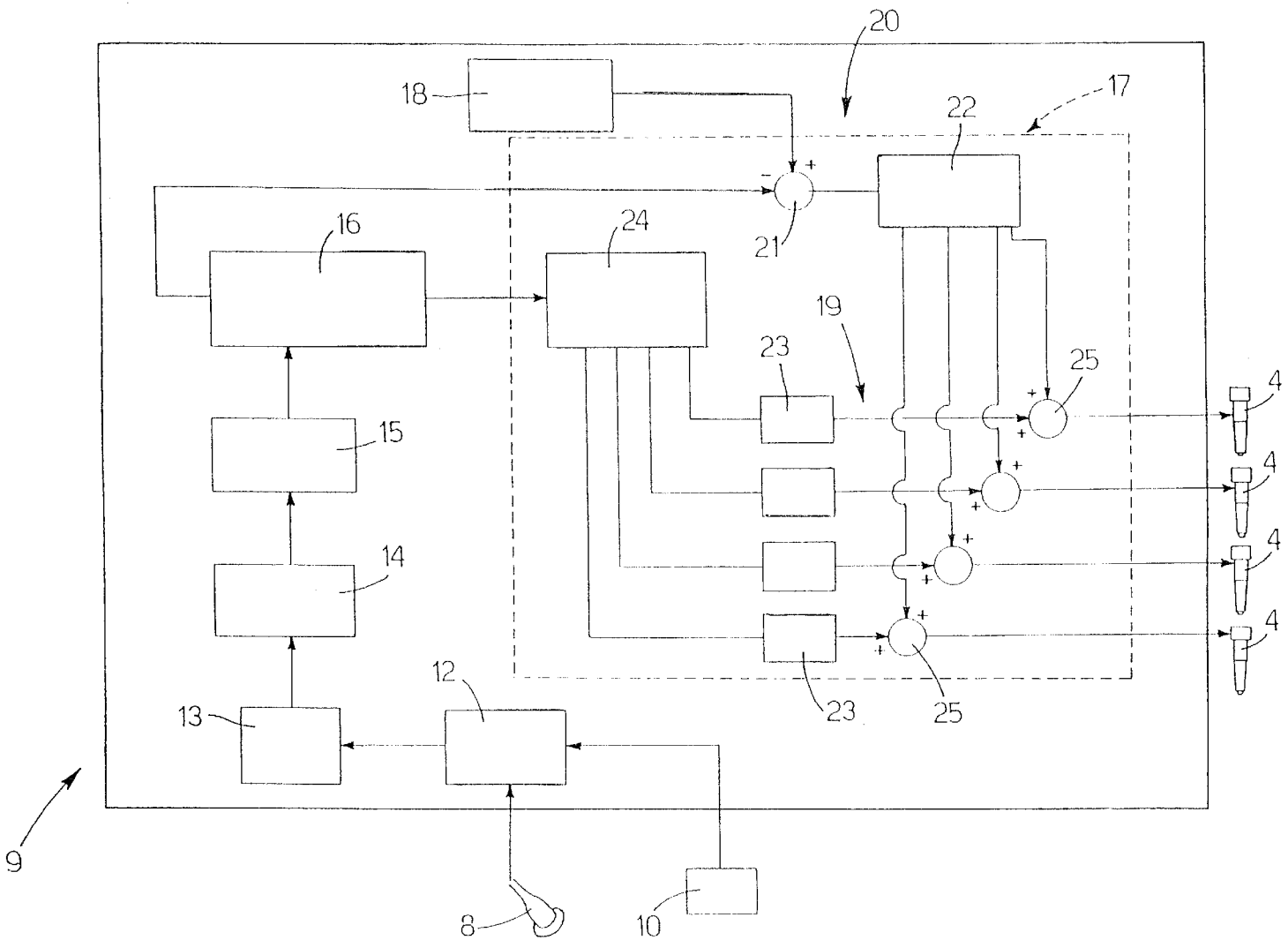
FIG. 2 is a diagrammatic view of a control unit of FIG. 1.

As shown in FIG. 2, the control unit 9 comprises a device 12 for filtering the measurement signal from the linear oxygen probe 8.

The filtering device 12 comprises a filter having a transfer function of a "high pass" type in order to filter the measurement signal of the overall air-fuel ratio of the cylinders 3 from the linear oxygen probe 8. The filter of the filtering device 12 has a transfer function in the Laplace domain comprising a zero and two poles which are disposed at frequencies higher than zero. The filtering device 12 further comprises a limitation of the filtered signal within a predetermined acceptability range in order to eliminate any noise pulse components.

The measurement signal from the liner oxygen probe 8 needs to be filtered to recover some dynamics weakened as a result of the response characteristics of the linear oxygen probe 8, particularly as a result of the capacitance effect due to a protective hood (known and not shown) of this probe 8. In order to obviate this critical factor, the filtering device amplifies the frequencies characteristic of the combustion phenomenon and at the same time reduces the high frequencies in order not to amplify noise.

The signal filtered by the filtering device 12 is strongly under-sampled by a sampling device 13, which stores four measurement values $AFR_{COMPL}$ of the overall air-fuel ratio of the cylinders 3 for each complete revolution of the engine shaft 11. The measurement values $AFR_{COMPL}$ are in particular stored at the exhaust phase of each cylinder 3 such that each measurement value $AFR_{COMPL}$ is as indicative as possible of the state of combustion of a respective cylinder 3. According to a preferred embodiment, the measurement values $AFR_{COMPL}$ are stored at each top dead centre of each cylinder 3.

As output from the sampling device 13, each measurement $AFR_{COMPL}$ is transmitted to a reconstruction device 14 which is adapted to estimate the values $AFR_{CIL}$ of the air-fuel ratio of each cylinder 3 by processing the measured values $AFR_{COMPL}$ of the overall air-fuel ratio.

After many experimental tests, it has been decided to use a model with two coefficients to represent the relationship existing between the measured values $AFR_{COMPL}$ of the overall air-fuel ratio and the estimated values $AFR_{CIL}$ of the air-fuel ratio of each cylinder 3. This model is summarised by the following equation:

$$AFR_{COMP}(k)=B_{RICOSTR}\star AFR_{CIL}(k)+A_{RICOSTR}\star AFR_{COMP}(k-1)$$

where $AFR_{COMP}$ (k) represents the $k^{th}$ measured value of the overall air-fuel ratio (i.e. the value measured at the moment k), $AFR_{COMP}(k-1)$ represents the $(k-1)^{th}$ measured value of the overall air-fuel ratio (i.e. the value measured at the moment k−1), and $AFR_{CIL}(k)$ represents the $k^{th}$ estimated value of the air-fuel ratio of the last cylinder 3 combusted (i.e. the estimated value of the air-fuel ratio of the cylinder 3 combusted at the moment k). $A_{RICOSTR}$ and $B_{RICOSTR}$ are two identified coefficients which are characteristic of the engine 3 and are obtained experimentally.

Resolving the above equation with respect to $AFR_{CIL}(k)$ provides:

$$AFR_{CIL}(k)=1/B_{RICOSTR}\star(AFRCOMP(k)-A_{RICOSTR}\star AFRCOMP(k-1))$$

which can be rewritten as:

$$AFR_{CIL}(k)=C1\star AFR_{COMP}(k)-C2\star AFR_{COMP}(k-1)$$

$C1=1/B_{RICOSTR}$ $C2=A_{RICOSTR}/B_{RICOSTR}$

It has been observed that the coefficients C1 and C2 are not constant but depend on the operating point of the engine 3, and in particular on the number of revolutions and the torque transmitted (or the quantity of air introduced) by the engine 3. It is preferable, therefore, to implement a table which supplies the values of C1 and C2 corrected for the current operating point of the engine 3 in a known manner within the reconstruction device 14.

It has further been observed that the coefficients $A_{RICOSTR}$ and $B_{RICOSTR}$, and therefore the coefficients C1 and C2, are not independent from one another, but are connected by the equation:

$$A_{RICOSTR}=1-B_{RICOSTR}$$

and therefore:

$$C2=C1-1$$

It is therefore possible to reduce the mathematical model to a single coefficient.

It will be appreciated from the above description that it is possible to estimate the value $AFR_{CIL}(k)$ of the air-fuel ratio of the final cylinder 3 combusted by means of a linear composition of the last measured value $AFR_{COMP}(k)$ and the penultimate measured value $AFR_{COMP}(k-1)$ of the overall air-fuel ratio.

On each complete revolution of the engine shaft 11, the sampling device 14 carries out an estimate of the values $AFR_{CIL}$ of the last four cylinders combusted applying the formulae:

$$AFR_{CIL}(k)=C1\star AFR_{COMP}(k)-C2\star AFR_{COMP}(k-1)$$

Once the values $AFR_{CIL}$ of the last four cylinders combusted have been estimated, the reconstruction device 14 supplies the four values $AFR_{CIL}$ to a synchroniser device 15 which associates each value $AFR_{CIL}$ with a respective cylinder 3 by means of a predetermined criterion of association stored in a memory of this synchroniser device 15.

According to a preferred embodiment, the above-mentioned association criterion is formed by a bi-univocal law of association, which associates each $AFR_{CIL}$ with a respective cylinder; for instance $AFR_{CIL}(k)$ is associated with the cylinder 3-I and will subsequently be indicated by the symbol $\lambda_{CIL1}$, $AFR_{CIL}$ (k−1) is associated with the cylinder 3-III and will subsequently be indicated by the symbol $\lambda_{CIL3}$, $AFR_{CIL}(k-2)$ is associated with the cylinder 3-II and will subsequently be indicated by the symbol $\lambda_{CIL2}$ and $AFR_{CIL}(k-3)$ is associated with the cylinder 3-IV and will subsequently be indicated by the symbol $\lambda_{CIL4}$.

The association law is initially determined in a theoretical manner by associating each estimated value $AFR_{CIL}$ of the air-fuel ratio with the cylinder 3 which, on the basis of the angular position of the engine shaft 11, is combusted at the moment closest to the moment of measurement of the value $AFR_{COMP}$ of the overall air-fuel ratio used in the estimate. This association criterion is not always valid, as it does not take account of the output velocity of the exhaust gases from the cylinders 3, which velocity is substantially different depending on the speed of rotation of the engine 2.

The above-mentioned association law is not constant but may be modified during the operation of the engine 2 in order to adapt to the changed operating conditions of this engine 2. The synchroniser device 15 in particular implements an algorithm which verifies the overall stability of the system in order to verify the accuracy of the current association law. It is also the case that if the association law is not correct the system becomes unstable i.e. the difference between the estimated values $\lambda_{CIL}$ of the air-fuel ratios of the cylinders 3 and a reference value $\lambda_{TARGET}$ of the air-fuel ratio over time tends to increase and not to decrease (i.e. tends to diverge and not to converge towards zero).

If the synchroniser device 15 discovers an instability in the system, this synchroniser device 15 modifies the association law, typically by modifying the bi-univocal association functions by one step; for instance:

Initial Association Law $AFR_{CIL}(k)\rightarrow$Cylinder 3-I ($\lambda_{CIL1}$)
$AFR_{CIL}(k-1)\rightarrow$Cylinder 3-III ($\lambda_{CIL3}$)
$AFR_{CIL}$ (k−2)→Cylinder 3-II ($\lambda_{CIL2}$)
$AFR_{CIL}$ (k−3)→Cylinder 3-IV ($\lambda_{CIL4}$)

Modified Association Law $AFR_{CIL}$ (k)→Cylinder 3-III ($\lambda_{CIL3}$)
$AFR_{CIL}$ (k−1)→Cylinder 3-II ($\lambda_{CIL2}$)
$AFR_{CIL}$ (k−2)→Cylinder 3-IV ($\lambda_{CIL4}$)
$AFR_{CIL}$ (k−3)→Cylinder 3-I ($\lambda_{CIL1}$)

In order to verify the stability of the system, the synchroniser device 15 calculates a value D of divergence of the estimated values $\lambda_{CIL}$ of the air-fuel ratio. This divergence value D is calculated using either the value of the derivative over time of the estimated values $\lambda_{CIL}$ of the air-fuel ratio of each cylinder 3 or by using the absolute value of the differences between the reference value $\lambda_{TARGET}$ and the estimated values $\lambda_{CIL}$ of the air-fuel ratio of each cylinder 3.

In particular, if the value of the derivative of an estimated value $\lambda_{CIL}$ is positive and the estimated value $\lambda_{CIL}$ itself is greater than the reference value $\lambda_{TARGET}$, there is a potential situation of instability.

If the divergence value D is higher than a predetermined threshold, the synchroniser device 15 then modifies the association law.

Once the association has been carried out, the synchroniser device 15 communicates the four values $\lambda_{CIL}$ ($\lambda_{CIL1}$, $\lambda_{CIL2}$, $\lambda_{CIL3}$, $\lambda_{CIL4}$, each of which indicates for a respective cylinder 3 an estimate of the air-fuel ratio with which this cylinder 3 is working, to a calculation device 16.

Once the four values $\lambda_{CIL}$ have been received, the calculation device 16 calculates a mean value $\lambda_{mean}$ of the air-fuel ratio of the four cylinders 3, and calculates for each cylinder 3 a respective dispersion value $\Delta_{CIL}$ indicating the difference between the corresponding value $\lambda_{CIL}$ of the cylinder 3 and the value $\lambda_{mean}$.

$$\lambda_{mean} = (\lambda_{CIL1} + \lambda_{CIL2} + \lambda_{CIL3} + \lambda_{CIL4})/4$$

$$\Delta_{CIL1} = \lambda_{CIL1} + \lambda_{mean}$$

$$\Delta_{CIL2} = \lambda_{CIL2} + \lambda_{mean}$$

$$\Delta_{CIL3} = \lambda_{CIL3} + \lambda_{mean}$$

$$\Delta_{CIL4} = \lambda_{Ci4} + \lambda_{mean}$$

The calculation device 16 communicates the value $\lambda_{mean}$ and the values $\Delta_{CIL}$ to a regulator 17 which is adapted to supply, to each injector 4, the above-mentioned correction signal for the quantity of fuel to be injected into the respective cylinder 3.

The regulator 17 receives the reference value $\lambda_{TARGET}$ of the air-fuel ratio from a memory 18 and attempts to cause each cylinder 3 to work with an air-fuel ratio which is as close as possible to the reference value $\lambda_{TARGET}$. The regulator 17 comprises two control loops 19 and 20, which are closed (i.e. work in feedback), are separate from one another and are disposed one within the other.

The control loop 19 corrects the dispersion values $\Delta_{CIL}$ by attempting to bring them to a zero value; in particular, the inner loop 19 has the task of recovering the imbalances of the air-fuel ratio of the various cylinders 3 by making corrections bearing a zero mean value.

The outer loop 20 carries out an overall control (i.e. without distinction between the various cylinders 3), attempting to adapt the mean value $\lambda_{mean}$ of the air-fuel ratio of the four cylinders 3 to the reference value $\lambda_{TARGET}$.

The outer loop 20 has a comparator 21, which compares, in negative feedback, the reference value $\lambda_{TARGET}$ with the mean value $\lambda_{mean}$ of the air-fuel ratio of the four cylinders 3; the error resulting from this comparison is supplied to a control device 22, which is typically a control device of PID type and is able to generate, as a function of the error signal received as input, a control signal for the injectors 4.

The inner loop 19 comprises four control devices 23, each of which receives as input a respective dispersion value $\Delta_{CIL}$ from the calculation device 16, is typically a control device of PID type and is able to generate, as a function of the signal received as input, a control signal for a respective injector 4. The inner loop 19 is for all purposes a closed feedback loop, wherein each dispersion value $\Delta_{CIL}$ is already an error signal to be cancelled out.

According to a preferred embodiment showed in FIG. 2, a filter 24, which has a transfer function of a "low pass" type and is adapted to cleanse the values $\Delta_{CIL}$ of high frequency noise, is disposed between the calculation device 16 and the control device 23.

The signal from each control device 23 is combined with a signal from the control device 22 by means of a respective adding device 25 and is supplied to a respective injector 4 to correct the quantity of fuel injected into the respective cylinder 3. In this way, the value of the air-fuel ratio of each cylinder 3 is corrected by combining a first correction signal, which is determined on the basis of a mean value $\lambda_{mean}$ of the air-fuel ratio of all the cylinders 3, with a second correction signal, which is determined on the basis of the estimated value $\lambda_{CIL}$ of the air-fuel ratio of the cylinder 3.

According to a preferred embodiment, the outer control loop 20 has lower time constants than the inner control loop 19; in other words, the outer control loop 20 is slower to respond than the inner control loop 19. This ensures a greater overall stability of the process of correction of the quantity of fuel injected by the injectors 4.

What is claimed is:

1. A method for controlling the titre of the air-fuel mixture in an internal combustion engine (2) provided with at least two cylinders (3), the method comprising the stages of analysing the exhaust gas present in a common exhaust manifold (6) in order to measure at least one value ($AFR_{COMP}$) of the overall air-fuel ratio of the cylinders (3), determining an estimated value ($AFR_{CIL}$; $\lambda_{CIL}$; $\Delta_{CIL}$) of the air-fuel ratio of a first cylinder (3) by processing the value ($AFR_{COMP}$) of the overall air-fuel ratio, and using this estimated value ($AFR_{CIL}$; $\lambda_{CIL}$; $\Delta_{CIL}$) of the air-fuel ratio of the first cylinder (3) to correct a titre of the air-fuel mixture introduced into the first cylinder (3), the method being characterised in that it comprises the measurement of at least two successive values ($AFR_{COMP}$) of the air-fuel ratio of the cylinders (3) and the determination of the estimated value ($AFR_{CIL}$; $\lambda_{CIL}$; $\Delta_{CIL}$) of the air-fuel ratio of the first cylinder (3) by carrying out a linear composition of the two successive values ($AFR_{COMP}$) of the overall air-fuel ratio of the cylinders (3).

2. A method as claimed in claim 1, in which the linear composition of the two successive values ($AFR_{COMP}$) of the overall air-fuel ratio of the cylinders (3) is carried out using a first coefficient (C1) multiplying a final measured value ($AFR_{COMP}$) of the overall air-fuel ratio and a second coefficient (C2) multiplying a penultimate measured value ($AFR_{COMP}$) of the overall air-fuel ratio, the second coefficient (C2) being obtained by subtracting the value 1 from the first coefficient (C1).

3. A method as claimed in claim 1, in which a value of the air-fuel ratio of each cylinder (3) is corrected by combining a first correction signal, which is determined on the basis of a mean value ($\lambda_{mean}$) of the air-fuel ratio of all the cylinders (3), with a second correction signal, which is determined on the basis of the estimated value ($AFR_{CIL}$; $\lambda_{CIL}$; $\Delta_{CIL}$) of the air-fuel ratio of the cylinder (3).

4. A method as claimed in claim 3, in which the first and second correction signals are processed in a first and a second control loop (19, 20) respectively which are separate from one another, the second control loop (20) being external to the first control loop (19) and having lower time constants than this first control loop (19).

5. A method as claimed in claim 4, in which, in the first control loop (19), the estimated value ($AFR_{CIL}$; $\lambda_{CIL}$; $\Delta_{CIL}$) of the air-fuel ratio of the respective cylinder (3) is expressed as a difference with respect to the mean value ($\lambda_{mean}$) of the air-fuel ratio of all the cylinders (3).

6. A method as claimed in claim 4, in which the first control loop (19) comprises a filter (24) having a transfer function of a "low pass" type.

7. A method as claimed in claim 1, in which a value ($AFR_{COMP}$) of the overall air-fuel ratio of the cylinders (3) is measured by means of a linear oxygen sensor (7) disposed within the common exhaust manifold (6), an output signal from the linear oxygen sensor (7) being sampled on the basis of the angular position of an engine shaft (11) in order to obtain, for each full revolution of the engine shaft (11), a number of measurements of the value ($AFR_{COMP}$) of the overall air-fuel ratio of the cylinders (3) equal to the number of cylinders (3).

8. A method as claimed in claim 7, in which an output signal from the linear oxygen sensor is sampled on the basis of the angular position of the engine shaft (11) in order to obtain a measurement of the value ($AFR_{COMP}$) of the overall air-fuel ratio of the cylinders (3) at each top dead centre of each cylinder (3).

9. A method as claimed in claim 7, in which the output signal from the linear oxygen sensor is filtered by means of a filter (12) having a transfer function of a "high pass" type.

10. A method as claimed in claim 9, in which the filter (12) has a transfer function in the Laplace domain comprising a zero and two poles, which are disposed at frequencies higher than zero.

11. A method as claimed in claim 9, in which the filter (12) comprises a limitation of the filtered signal within a predetermined acceptability range.

12. A method as claimed in claim 1, in which a number of estimated values ($AFR_{CIL}$; $\lambda_{CIL}$; $\Delta_{CIL}$) of the air-fuel ratio equal to the number of cylinders (3) of the engine (2) are determined in succession, and each of the estimated values ($AFR_{CIL}$; $\lambda_{CIL}$; $\Delta_{CIL}$) of the air-fuel ratio is associated with a respective cylinder (3) by means of a predetermined association criterion.

13. A method as claimed in claim 12, in which a degree of divergence (D) of the estimated values ($AFR_{CIL}$; $\lambda_{CIL}$; $\Delta_{CIL}$) of the air-fuel ratio with respect to a condition of relative stability is determined, the association criterion being modified when the degree (D) of divergence is greater than a predetermined threshold.

14. A method as claimed in claim 13, in which the degree (D) of divergence is determined using the value of the derivative over time of the estimated values ($AFR_{CIL}$; $\lambda_{CIL}$; $\Delta_{CIL}$) of the air-fuel ratio of each cylinder (3) and using the absolute value of the differences between a predetermined theoretical value ($\lambda_{TARGET}$) and the estimated values ($AFR_{CIL}$; $\lambda_{CIL}$; $\Delta_{CIL}$) of the air-fuel ratio of each cylinder (3).

* * * * *